US006496801B1

(12) United States Patent
Veprek et al.

(10) Patent No.: US 6,496,801 B1
(45) Date of Patent: Dec. 17, 2002

(54) SPEECH SYNTHESIS EMPLOYING CONCATENATED PROSODIC AND ACOUSTIC TEMPLATES FOR PHRASES OF MULTIPLE WORDS

(75) Inventors: Peter Veprek, Santa Barbara, CA (US); Steve Pearson, Santa Barbara, CA (US); Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/432,876

(22) Filed: Nov. 2, 1999

(51) Int. Cl.[7] ..... G10L 13/08
(52) U.S. Cl. ..... 704/260; 704/267
(58) Field of Search ..... 704/260, 267

(56) References Cited

U.S. PATENT DOCUMENTS 5,727,120 A 3/1998 Van Coile et al.
5,905,972 A * 5/1999 Huang et al. ..... 704/268
6,052,664 A * 4/2000 Van Coile et al. ..... 704/260
6,175,821 B1 * 1/2001 Page et al. ..... 704/258
6,185,533 B1 * 2/2001 Holm et al. ..... 704/267
6,260,016 B1 * 7/2001 Holm et al. ..... 704/260

* cited by examiner

*Primary Examiner*—Tālivaldis Ivars Šmits
(74) *Attorney, Agent, or Firm*—Harness, Dickey & Pierce, PLC

(57) ABSTRACT

A speech synthesis system for generating voice dialog for a message frame having a fixed and a variable portion. A prosody module selects a prosodic template for each of the fixed and variable portions wherein at least one portion comprises a phrase of multiple words. An acoustic module selects an acoustic template for each of the fixed and variable portions wherein at least one portion comprises a phrase of multiple words. A frame generator concatenates the respective prosodic templates and acoustic templates. A sound module generates the voice dialog in accordance with the concatenated prosodic and acoustic templates.

16 Claims, 5 Drawing Sheets

SPEECH SYNTHESIS EMPLOYING CONCATENATED PROSODIC AND ACOUSTIC TEMPLATES FOR PHRASES OF MULTIPLE WORDS

BACKGROUND AND SUMMARY OF THE INVENTION

The present invention relates generally to speech synthesis and, more particularly, to producing naturally computer-generated speech by identifying and applying speech patterns in a voice dialog scenario.

In a typical voice dialog scenario, the structure of the spoken messages is fairly well defined. Typically, the message consists of a fixed portion and a variable portion. For example, in a vehicle speech synthesis system, a spoken message may comprise the sentence "Turn left of on Mason Street." The spoken message consists of a fixed or carrier portion and a variable or slot portion. In this example, "Turn left on _____" defines the fixed or carrier portion, and the name of the street "Mason Street" defines the variable or slot portion. As the identifier implies, the speech synthesis system may change the variable portion so that the speech synthesis system can direct a driver to follow directions involving multiple streets or highways.

Existing speech synthesis systems typically handle the insertion of the variable portion into the fixed portion rather poorly, creating a rather choppy and unnatural speech pattern. One approach to improving the quality for generating voice dialog can be found with reference to U.S. Pat. No. 5,727,120 (Van Coile), issued Mar. 10, 1998. The Van Coil patent receives a message frame having a fixed and variable portion and generates a markup for the entire message frame. The entirety of the message frame is broken down to phonemes, and necessarily requires a uniform presentation of the message frame. In the speech markup of an enriched phonetic transcription formulated with the phonemes, the control parameters are provided at the phoneme level. Such a markup does not guarantee optimal acoustic sound unit selection when rebuilding the message frame. Further, the pitch and duration of the message frame, known as the prosody, is selected for the entire message frame, rather than the individual fixed and variable portions. Such a message frame construction renders building the frame inflexible, as the prosody of the message frame remains fixed. Further, it is desirable to change the prosody of the variable portion of a given message frame.

The present invention takes a different, more flexible approach in building the fixed and variable portions of the message frame. The acoustic portion of each of the fixed and variable portions is constructed with predetermined set of acoustic sound units. A number of prosodic templates are stored in a prosodic template database, so that one or a number of prosodic templates can be applied to a particular fixed and variable portion of the message frame. This provides great flexibility in building the message frames. For example, one, two, or even more prosodic templates can be generated for association with each fixed and variable portion, thereby providing various inflections in the spoken message. Further, the prosodic templates for the fixed portion and variable portion can thus be generated separately, providing greater flexibility in building a library database of spoken messages. For example, the acoustic and prosodic fixed portion can be generated at the phoneme, word, or sentence level, or simply be pre-recorded. Similarly, templates for the variable portion may be generated at the phoneme, word, phrase level, or simply be pre-recorded. The different fixed and variable portions of the message frame are concatenated to define a unified acoustic template and a unified prosodic template.

For a more complete understanding of the invention, its objects and advantages, reference should be made to the following specification and to the accompanying drawings.

DESCRIPTION OF THE PREFERRED EMBODIMENT

Figure 1:
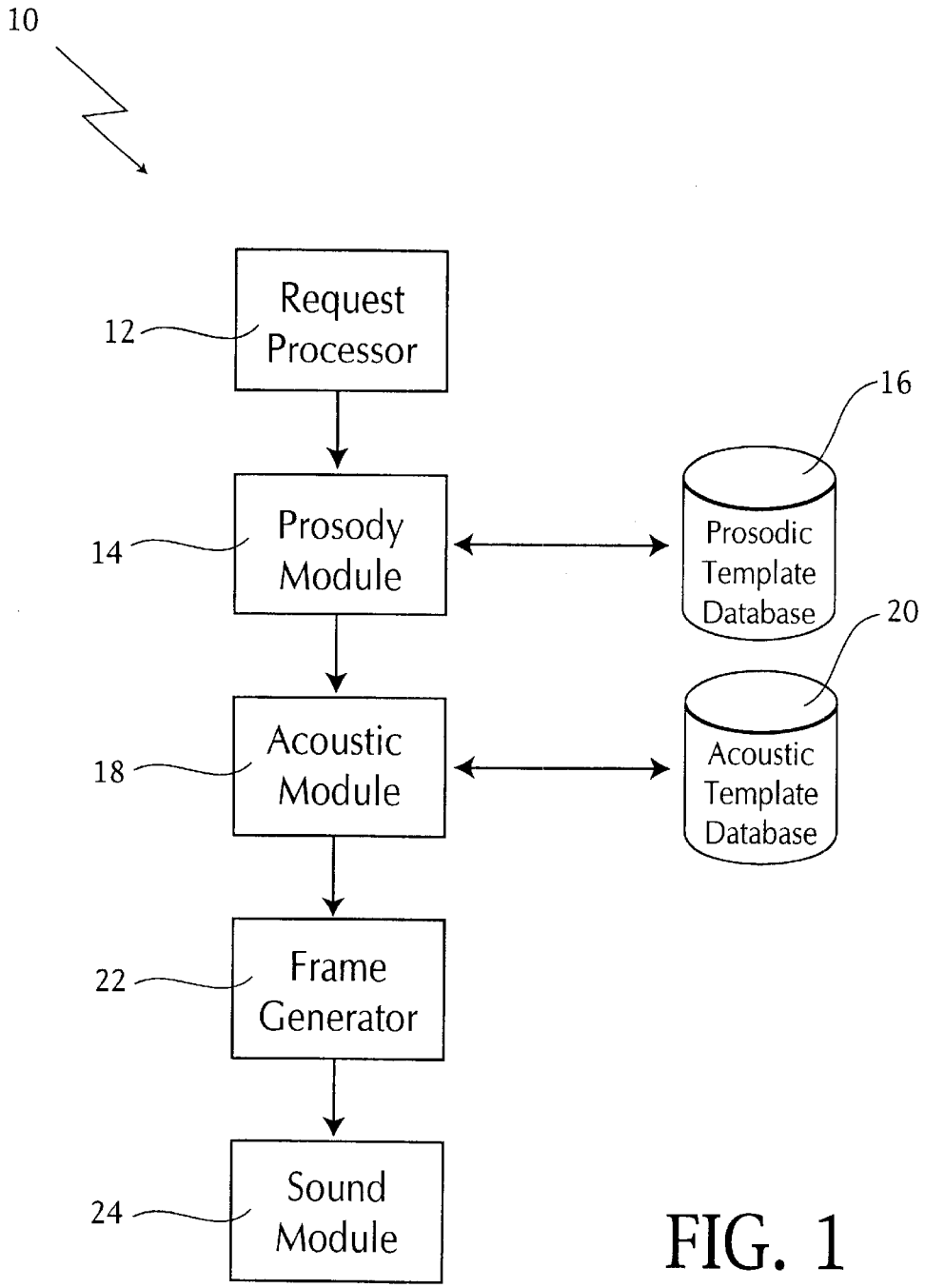
FIG. 1 is a block diagram of a speech synthesis system arranged in accordance with the principles of the present invention.

The speech synthesis system 10 of the present invention will be described with respect to FIGS. 1–6. With particular respect to FIG. 1, speech synthesis system 10 includes a request processor 12 which receives a request input to speech synthesis system 10 for providing a specific spoken message. Request processor 12 selects a message frame or frames in response to the requested spoken message.

As described above, a frame consists of a fixed or carrier portion and a variable or slot portion. In another example, the message "Your attention please. Mason Street is coming up in 30 seconds." defines an entire message frame. The portion "_____ is coming up in _____ seconds" is a fixed portion. The blanks are filled in with a respective street name, such as "Mason Street" and time period, such as "30." In addition, a fixed phrase, may be defined as a carrier with no slot, such as "Your attention please."

Request processor 12 outputs a frame to prosody module 14. Prosody module 14 selects a prosodic template for each portion of the frame. In particular, prosody module 14 selects one of a plurality of available prosodic templates for defining the prosody of the fixed portion. Similarly, prosody module 14 selects one of a plurality of prosodic templates for defining the prosody of the variable portion. Prosody module 14 accesses prosodic template database 16 which stores the available prosodic templates for each of the fixed and variable portions of the frame. After selection of the prosodic templates, acoustic module 18 selects acoustic templates corresponding to the fixed and variable portions of the frame. Acoustic module 18 accesses acoustic template database 20 which stores the acoustic templates for the fixed and variable portions of the frame.

Control then passes to frame generator 22. Frame generator 22 receives the prosodic templates selected by prosody module 14 and the acoustic templates selected by acoustic module 18. Frame generator then concatenates the selected prosodic templates and also concatenates the selected acoustic templates. The concatenated templates are then output to sound module 24. Sound module 24 generates sound for the frame using the selected prosodic and acoustic templates.

Figure 2:
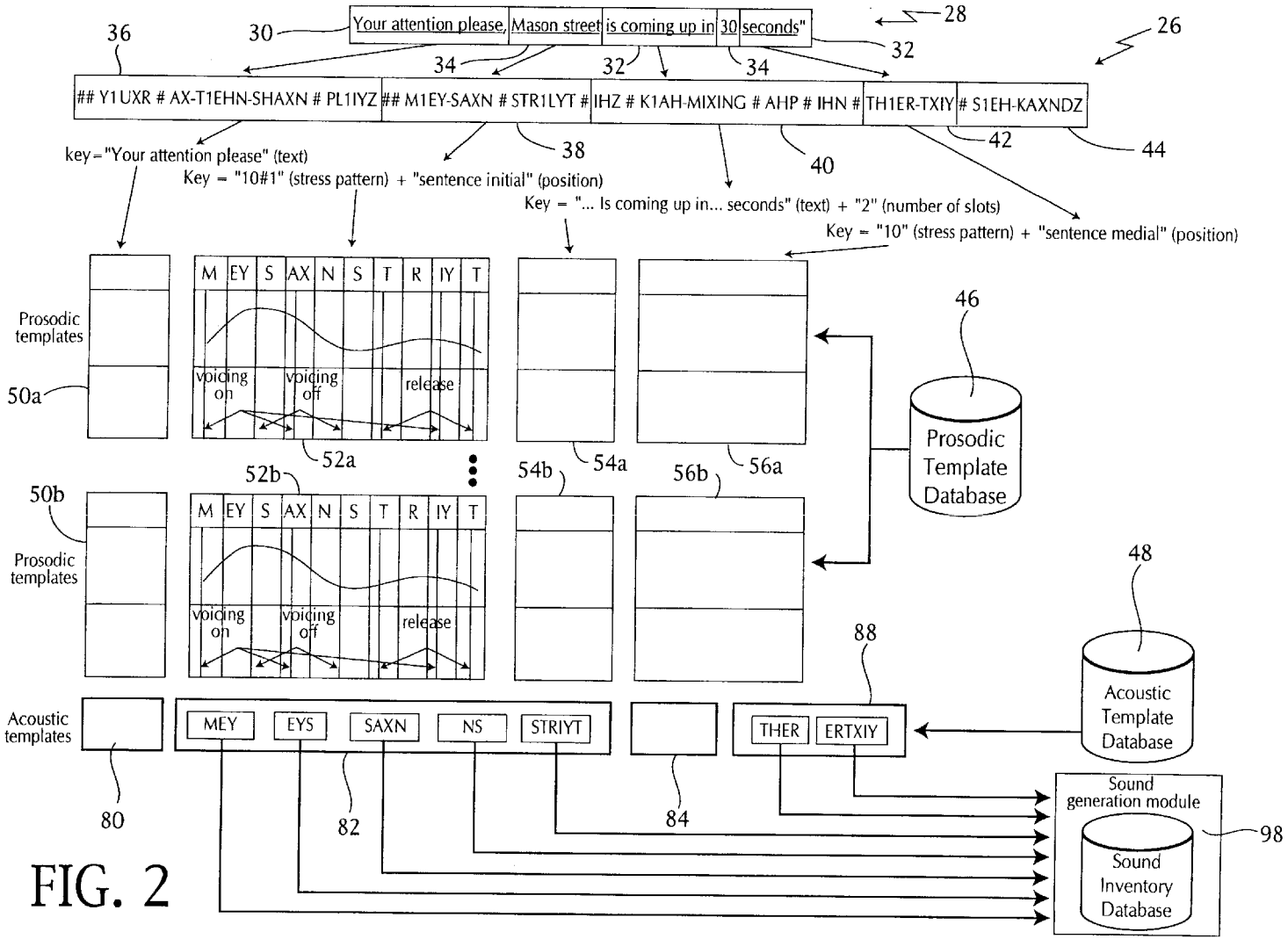
FIG. 2 is a block diagram of a message frame and the component prosodic and acoustic templates used to build the message frame.

FIG. 2 depicts an exemplary frame 26 for converting a text message to a spoken message. Text message or frame 28 includes a fixed phrase 30 ("Your attention please.") and a fixed portion or carrier 32 ("_____ is coming up in _____ seconds.") and two variable portions or slots 34 ("Mason Street" and "30"). Frame 28 is requested by request processor 12 of FIG. 1. Request processor 12 breaks down the frame 28 into an acoustic/phonetic representation. For example, acoustic representation 36 corresponds to fixed phrase 30 ("Your attention please"). Acoustic representation 38 corresponds to variable portion 34 ("Mason Street"). Acoustic representation 40 corresponds to fixed portion 32 ("is coming up in"). Acoustic representation 42 corresponds to variable portion 34 ("30"). Acoustic representation 44 corresponds to fixed portion 32 ("seconds"). Each acoustic representation is assigned a key which defines a selection criteria into prosodic template database 46 and acoustic template database 48. Prosodic template database 46 operates as described with respect to prosodic template database 16 of FIG. 1, and acoustic database 48 operates as described with respect to acoustic template database 20 of FIG. 1.

As described above, prosody module 14 selects a prosodic template from the prosodic template database 16. As shown in FIG. 2, for each fixed phrase 30, fixed portion 32, and variable portion 34, at least one prosodic template is provided. Specifically, prosody module 14 alternatively selects between prosodic templates 50*a* and 50*b* to define the prosody of fixed phrase 30. Prosody module 14 alternatively selects between prosodic template 52*a* and 52*b* to define the prosody of variable portion 34 ("Mason Street"). Prosody module 14 alternatively selects between prosodic templates 54*a* and 54*b* to define the prosody of fixed portion 32 ("is coming up in"). Similarly, prosody module 14 alternatively selects between prosodic templates 56*a* and 56*b* to define the prosody of fixed phrase 34 ("30"). Additional prosodic template selection occurs similarly for fixed portion 32 ("seconds"). Prosodic templates 50–56 are stored in prosodic template database 46. As shown herein, a pair of prosodic templates may be used to define the prosody for each acoustic representation 36–44. However, one skilled in the art will recognize that one template or greater than two templates may be similarly used to selectably define the prosody of each acoustic representation.

Figure 3:
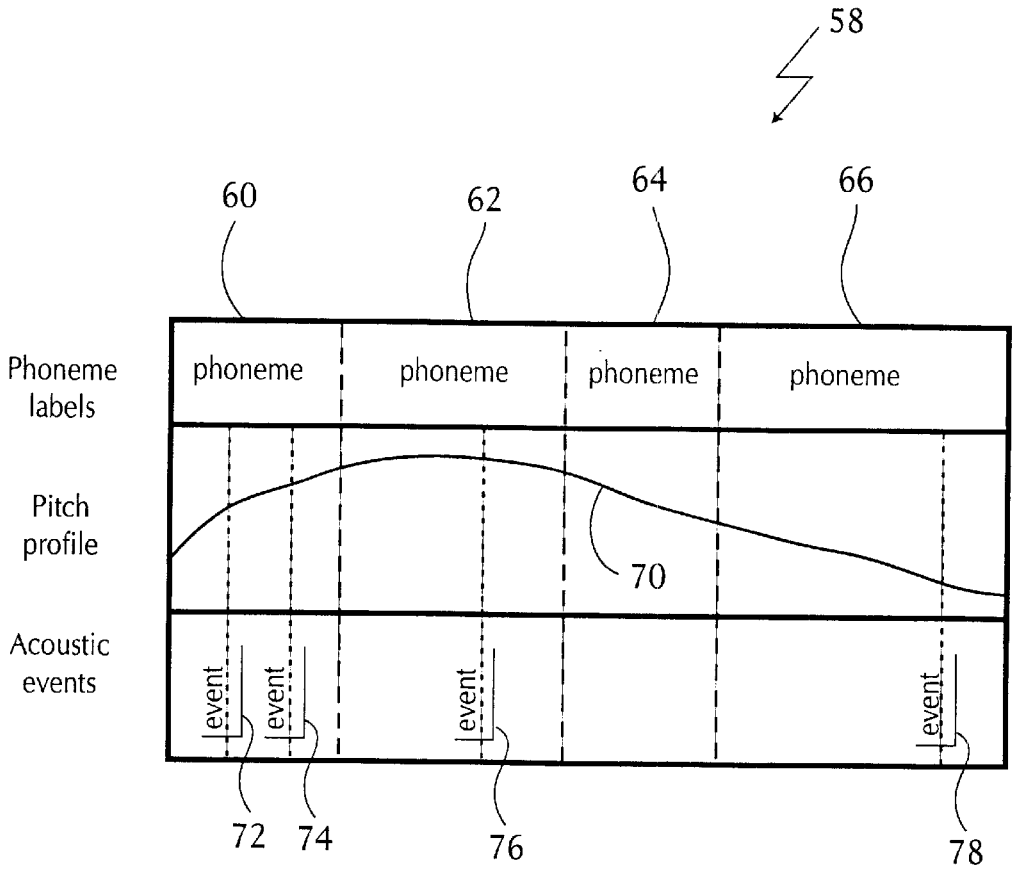
FIG. 3 is a diagram of a prosodic template.

FIG. 3 depicts an expanded view of an example prosodic template 58 for one acoustical representation of FIG. 2. Prosodic template 58 effectively subdivides an acoustic representation into phonemes. Prosodic template 58 includes a phoneme description 60, 62, 64, 66. Each phoneme description 60–66 includes a phoneme label that corresponds to the phoneme in the acoustic representation. Prosodic template 58 includes a pitch profile represented by a smooth curve, such as 70 of FIG. 3, and a series of acoustic events 72, 74, 76, and 78 of FIG. 3. Pitch profile 70 has labels referring to the individual phoneme descriptions 60–66. Pitch profile 70 also has references to acoustic events 72–78, thereby specifying the timing profile with respect to the acoustic events 72–78. Location of the acoustic events 72–78 within the pitch profile 70 can be used to perform time modification of the pitch profile 70, can assist in concatenation of the prosodic templates in the frame generator 22, and be used to align the prosodic templates with acoustic templates in the sound module 24.

For the fixed portion 32, prosodic templates similar to prosodic template 58 cover the entire fixed portion at arbitrary fine time resolution. Such templates for the fixed portions may be obtained either from recordings the fixed portions or stylizing the fixed portion. For the variable message portions 34, prosodic templates, similar to prosodic template 58, cover the entire variable portion at fine resolution. Because the number of actual variable portions 34, however, can be very large, generalized templates are needed. The generalized, prosodic templates are obtained by first performing statistical analysis of individual recorded realizations from the variable portions, then grouping similar realizations into classes and generalizing the classes in a form of templates. By way of example, pitch patterns for individual words are collected from recorded speech, clustered into classes based on the word stress pattern, and word-level pitch templates for each stress pattern are generated. At run time, the generalized templates are modified. For example, the pitch templates may be shortened or lengthened according to the timing template. In addition to the described process of obtaining the templates, the templates can also be stylized.

Referring back to FIGS. 1 and 2, after prosody module 14 has selected the desired prosodic templates from prosodic template database 16, acoustic module 18 similarly selects acoustic templates from acoustic template database 20. FIG. 2 depicts acoustic templates which are stored in acoustic template database 48. For example, acoustic template 80 corresponds to fixed phrase 30. Acoustic template 82 corresponds to variable portion 34 ("Mason Street"). Acoustic template 84 corresponds to fixed portion 32. Similarly, acoustic template 86 corresponds to variable portion 34 ("30"). As shown in FIG. 2, acoustic templates 80, 84, 86, 88 are exemplary acoustic templates used when a concatenated synthesizer is employed, i.e., a sound inventory of speech units is represented digitally and concatenated to formulate the acoustic output.

Figure 4:
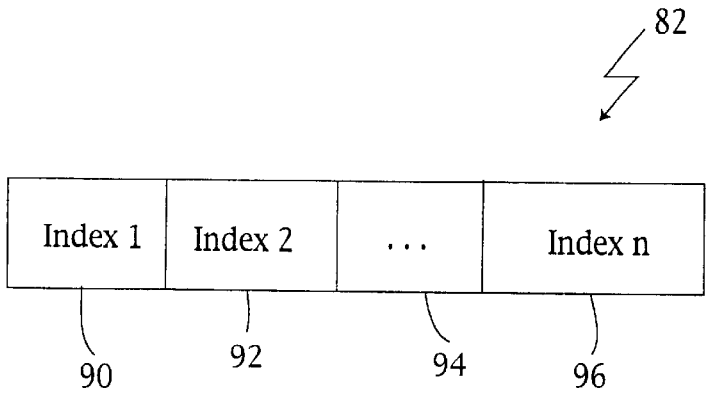
FIG. 4 is a diagram of an acoustic template.

Acoustic templates 80–88 specify the unit selection or index in this embodiment. FIG. 4 depicts an expanded view of a generic representation of an exemplary acoustic template 82. Acoustic template 82 comprises a plurality of indexes index 1, index 2, . . . , index n, referred to respectively by acoustic template sections 90, 92, 94, 96. Each acoustic template section 90–96 represents an index into sound inventory database 98, and each index refers to a particular unit in sound inventory database 98. The acoustic templates 80–88 described herein need not follow the same format. For example, the acoustic templates can be defined in terms of various sound units including phonemes, syllables, words, sentences, recorded speech, and the like.

The acoustic templates, such as acoustic template 82, define acoustic characteristics of the fixed portions 32, variable portions 34 and fixed phrases 30. The acoustic templates define the acoustic characteristic similarly to how the prosodic templates define the prosodic characteristics of the fixed portions, variable portions, and fixed phrases. Depending upon the actual implementation, acoustic templates may hold the acoustic sound unit selection in the case of a concatenative synthesizer (text to speech), or may hold target values of controlled parameters in the case of a rule-based synthesizer. Depending upon the implementation, the acoustic templates may be required for all, or only some of, the fixed portion, variable portion, and fixed phrases. Further, the acoustic templates cover the entire fixed portion at fine fixed time resolution. These templates may be mixed in size and store phoneme, syllable, word, sentence, or may even be prerecorded speech.

Figure 5:
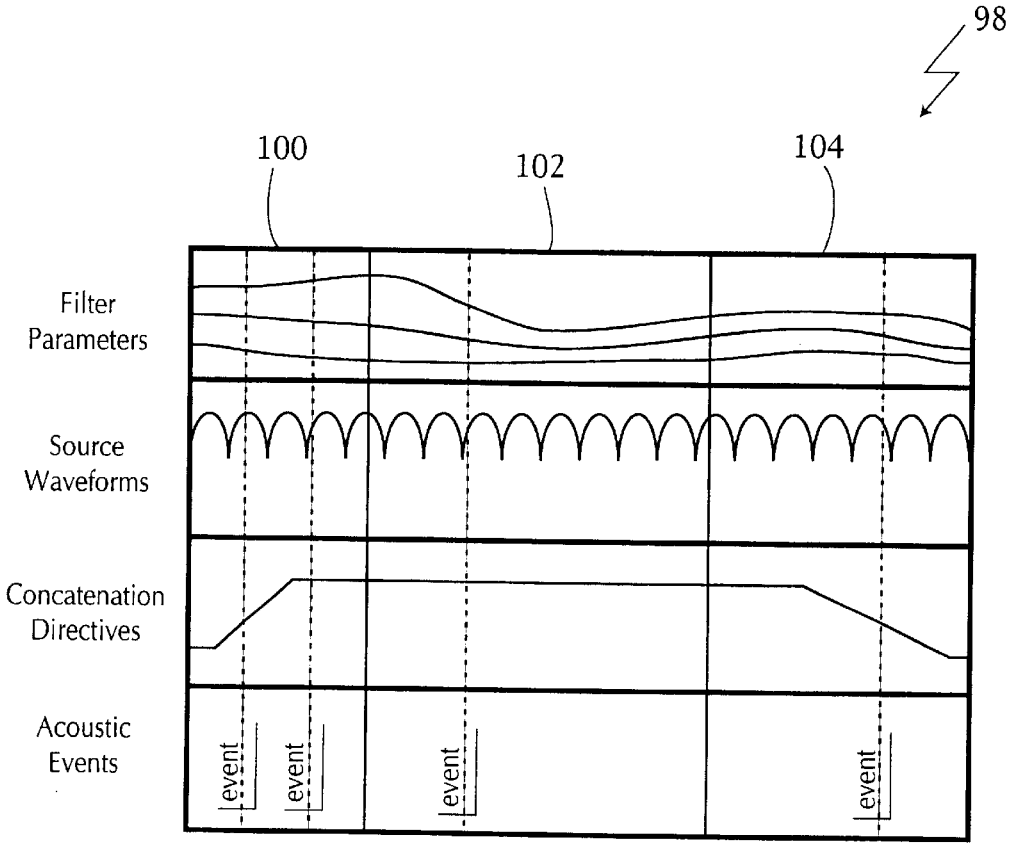
FIG. 5 is a diagram of an acoustic unit from the sound inventory database.

As stated above, for use in a concatenative synthesizer, acoustic templates 80–88 need only contain indexes into sound inventory database 98. As best seen in FIG. 5, sound inventory database 98 includes a plurality of exemplary acoustic units 100, 102, 104 which are concatenated to formulate the acoustic speech. Each acoustic unit is defined by filter parameters and a source waveform. Alternatively, an acoustic unit may be defined by various other representations known by those skilled in the art. Each acoustic unit also includes a set of concatenation directives which include rules and parameters. The concatenation directives specify the manner of concatenating the filter parameters in the frequency domain and the source waveforms in the time domain. Each acoustic unit 100, 102, 104 also includes markings for the particular acoustic event to enable synchronization of the acoustic events. The acoustic units 100, 102, 104 are pointed to by the indexes of acoustic template, such as acoustic template 82. These acoustic units 100, 102, 104 are then concatenated to provide the acoustic speech.

Figure 6:
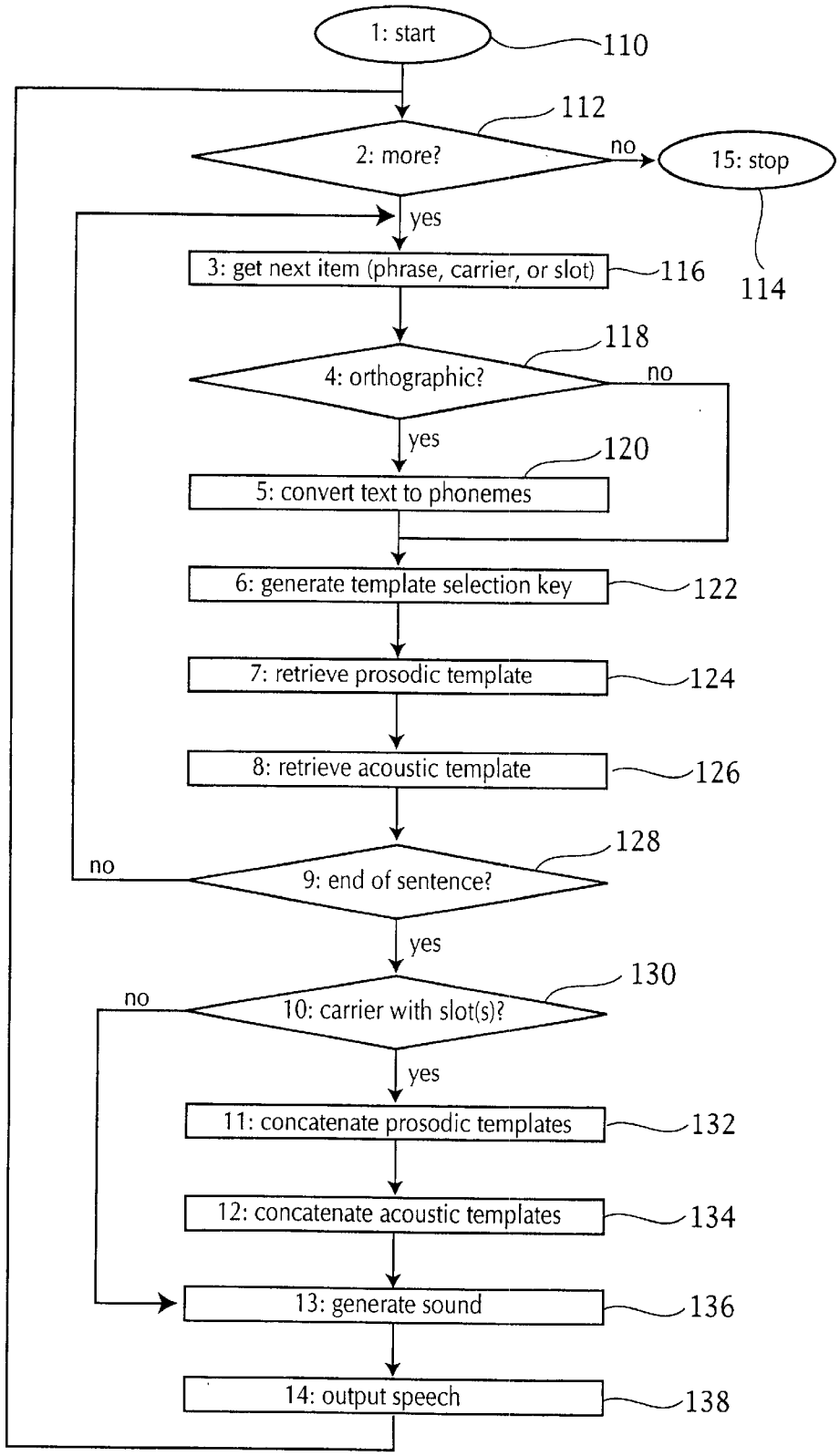
FIG. 6 is a flow diagram displaying operation of the speech synthesis system.

FIG. 6 depicts a block diagram for carrying out a method for speech synthesis as defined in the apparatus of FIGS. 1–2. Control begins at process block 110 which indicates the start of the speech synthesis routine. Control proceeds to decision block 112. At decision block 112, a test determines if additional frames are requested for output speech. If no additional frames are requested, control proceeds to process block 114 which completes the routine.

If additional frames are requested for output speech, control proceeds to process block 116 which obtains a portion of the particular frame for output speech. That is, one of the fixed, variable, or fixed phrase portions of the message frame is selected. The selected portion is input to decision block 118 which tests to determine whether the selected portion is an orthographic representation. If the selected portion is an orthographic representation, control proceeds to process block 120 which converts the text of the orthographic representation to phonemes. Control then proceeds to process block 122. Returning to decision block 118, if the selected portion is not in an orthographic representation, control proceeds to process block 122.

Process block 122 generates the template selection keys as discussed with respect to FIG. 2. The template selection key may be a relatively simple text representation of the item or it can contain features in addition to or instead of the text. Such features include phonetic transcription of the item, the number of syllables within the item, a stress pattern of the item, the position of the item within a sentence, and the like. Typically the text-based key is used for fixed phrases or carriers while variable or slot portions are classified using features of the item.

Once the selection keys have been generated, control proceeds to process block 124. Process block 124 retrieves the prosodic templates from the prosodic database. Once the prosodic templates have been retrieved, control proceeds to process block 126 where the acoustic templates are retrieved from the acoustic database. Control then proceeds to decision block 128. At decision block 128, a test determines if the end of the frame or sentence has been reached. If the end of the frame or sentence has not been reached, control proceeds to process block 116 which retrieves next portion of the frame for processing as described above with respect to blocks 116–128. If the end of the frame or sentence has been reached, control proceeds to decision block 130.

At decision block 130, a test determines if the fixed portion includes one or more variable portions. If the fixed portion of the frame includes one or more variable portions, control proceeds to process block 132. Process block 132 concatenates the prosodic templates selected at block 124 and control proceeds to process block 134. At process block 134, the acoustic templates selected at process block 126 are concatenated.

Control then proceeds to process block 136 which generates sounds for the frame using the prosodic and acoustic templates. The sound is generated by speech synthesis from control parameters. As described above, the control parameters can have the form of a sound inventory of acoustical sound units represented digitally for concatenative synthesis and/or prosody transplantation. Alternatively, the control parameters can have the form of speech production rules, known as rule-based synthesis. Control then proceeds to process block 138 which outputs the generated sound to an output device. From process block 138, control proceeds to decision block 112 which determines if additional frames are available for output. If no additional frames are available, control proceeds to process block 114 which ends the routine.

In view of the foregoing, one can see that utilizing the prosodic and acoustic templates for each variable and fixed portion of a message improves the quality of the voice dialog output by the speech synthesis system. By selecting prosodic templates from a prosodic database for each of the fixed and variable portions of a message frame and similarly selecting an acoustic template for each of the fixed and variable portions of the message frame, a more natural speech pattern can be realized. Further, the selection as described above provides improved flexibility in selection of the fixed and variable portions, as one of a plurality of prosodic templates can be associated with a particular portion of the frame.

While the invention has been described in its presently preferred form, it is to be understood that there are numerous applications and implementations for the present invention. Accordingly, the invention is capable of modification and changes without departing from the spirit of the invention as set forth in the appended claims.

What is claimed is:

1. An apparatus for producing synthesized speech frames having a fixed portion and a variable portion, comprising:

a prosody module receptive of a frame having a fixed portion and a variable portion, wherein at least one of said fixed portion and said variable portion comprises a phrase of multiple words, the prosody module including a database of prosodic templates operable to provide prosody information for phrases of multiple words, the prosody module selecting a first prosodic template for said fixed portion and a second prosodic template for said variable portion;

an acoustic module receptive of the first prosodic template and the second prosodic template and including a database of acoustic templates operable to provide acoustic information for phrases of multiple words, the acoustic module selecting a first acoustic template for said fixed portion and a second acoustic template for said variable portion; and a frame generator, the frame generator concatenating the prosodic templates for the respective fixed and variable portions and concatenating the respective acoustic templates for the fixed and variable portions, the frame generator combining the concatenated prosodic templates and the concatenated acoustic templates to define the synthesized speech.

2. The apparatus of claim 1 wherein the acoustic database includes at least one of synthesized and recorded speech.

3. The apparatus of claim 1 wherein the fixed portion is defined as one of a carrier and a fixed phrase and wherein the carrier has slots into which is inserted the variable portion and the fixed phrase has no slots.

4. The apparatus of claim 1 wherein the prosody database includes at least one of synthesized and recorded speech.

5. The apparatus of claim 1 wherein a plurality of prosodic templates may be selected for each of the fixed portion and variable portion.

6. The apparatus of claim 1 wherein the sound unit comprises one of the group of phoneme, syllable, word, sentence, and pre recorded speech.

7. The apparatus of claim 1 further comprising a sound inventory database, wherein a predetermined sound unit points to an acoustic unit within the sound inventory database, each acoustic unit further comprising a filter parameter, a source waveform, and a set of concatenation directives.

8. The apparatus of claim 7 wherein each acoustic unit is further defined by an acoustic event.

9. The apparatus of claim 7 wherein the sound unit defines an index into the sound inventory database.

10. The apparatus of claim 1 wherein the prosodic template includes a phoneme label, a pitch profile, and an acoustic event definition.

11. A method for producing synthesized speech in the form of a frame having a fixed portion and a variable portion, comprising:

receiving a speech frame having a fixed portion and a variable portion;

selecting each of the fixed portion and the variable portion of the speech frame, wherein at least one portion comprises a phrase of multiple words, and for each portion:

(a) generating a template selection criteria in accordance with the selected portion;

(b) retrieving a prosodic template from a database of prosodic templates operable to provide prosody information for phrases of multiple words, the retrieved prosodic template defining a prosody for the selected portion; and (c) retrieving an acoustic template from a database of acoustic templates operable to provide acoustic information for phrases of multiple words, the retrieved acoustic template defining an acoustic output for the selected portion;

concatenating the prosodic templates of the selected portions;

concatenating the acoustic templates of the selected portions; and combining the concatenated prosody templates and the concatenated acoustic templates to define the synthesized speech.

12. The method of claim 11 wherein the step of generating sound further comprises selecting from a database of digitally represented acoustic sound units.

13. The method of claim 11 wherein the step of generating sound units further comprises utilizing rule-based synthesis.

14. The method of claim 11 wherein the step of generating a selection criteria further comprises the step of utilizing at least one of a text based selection and a feature based selection.

15. The method of claim 11 wherein the step of retrieving for the selected portion a prosodic template further comprises the step of retrieving one prosodic template out of a plurality of suitable prosodic templates.

16. The apparatus of claim 11 wherein the acoustic sound unit comprises one of the group of phoneme, syllable, word, sentence, and pre recorded speech.

* * * * *